US012480749B2

(12) United States Patent
Laporte et al.

(10) Patent No.: US 12,480,749 B2
(45) Date of Patent: Nov. 25, 2025

(54) TARGET THROWING MACHINE

(71) Applicant: LAPORTE HOLDING, Biot (FR)

(72) Inventors: Jean-Michel Laporte, Biot (FR); Jean-Marc Fouques, Antibes (FR)

(73) Assignee: LAPORTE HOLDING, Biot (FR)

( * ) Notice: Subject to any disclaimer, the term of this patent is extended or adjusted under 35 U.S.C. 154(b) by 158 days.

(21) Appl. No.: 18/262,389

(22) PCT Filed: Jan. 26, 2022

(86) PCT No.: PCT/EP2022/051707
§ 371 (c)(1),
(2) Date: Jul. 21, 2023

(87) PCT Pub. No.: WO2022/167278
PCT Pub. Date: Aug. 11, 2022

(65) Prior Publication Data

US 2024/0077289 A1 Mar. 7, 2024

(30) Foreign Application Priority Data

Feb. 2, 2021 (FR) ..... 2101000

(51) Int. Cl.
*F41J 9/18* (2006.01)
*F41J 9/20* (2006.01)
(Continued)

(52) U.S. Cl.
CPC .. *F41J 9/30* (2013.01); *F41J 9/20* (2013.01)

(58) Field of Classification Search
CPC .. F41J 9/18; F41J 9/30; F41J 9/32; F41J 9/20
(Continued)

(56) References Cited

U.S. PATENT DOCUMENTS 2,135,603 A * 11/1938 Roth ..... F41J 9/20 124/32
2,136,034 A * 11/1938 Altemus ..... F41J 9/20 124/31
(Continued)

FOREIGN PATENT DOCUMENTS

DE 202004013738 U1 * 12/2004 ..... F41J 9/32
FR 2733043 A1 * 10/1996 ..... F41J 9/18
(Continued)

OTHER PUBLICATIONS

International Search Report issued in corresponding International Application No. PCT/EP2022/051707, dated Apr. 5, 2022, pp. 1-3, European Patent Office, Rijswijk, Netherlands.
(Continued)

*Primary Examiner* — Alexander R Niconovich
(74) *Attorney, Agent, or Firm* — HAUPTMAN HAM, LLP

(57) ABSTRACT

A target throwing machine includes a base and a turret surmounted by a throwing unit, the turret being movable in rotation relative to the base according to a main axis. The base includes an upper surface and the turret includes a lower surface opposite the upper surface. In which machine an intermediate system is interposed between the upper surface and the lower surface, the intermediate system being in contact with the upper surface and the lower surface and forming a sliding interface between the intermediate system and the upper surface and/or the lower surface.

12 Claims, 5 Drawing Sheets

(51) Int. Cl.
*F41J 9/30* (2006.01)
*F41J 9/32* (2006.01)

(58) Field of Classification Search
USPC ..... 124/6, 8, 9
See application file for complete search history.

(56) References Cited

U.S. PATENT DOCUMENTS

| | | | | | |
|---|---|---|---|---|---|
| 2,136,035 | A * | 11/1938 | Altemus | F41J 9/20 | 403/115 |
| 3,070,082 | A * | 12/1962 | Foster | F41J 9/20 | 124/8 |
| 3,722,495 | A * | 3/1973 | Hansen | F41J 9/32 | 124/32 |
| 4,146,008 | A * | 3/1979 | Rowlands | F41J 9/18 | 124/43 |
| 5,249,563 | A * | 10/1993 | Patenaude | F41J 9/30 | 124/8 |
| 6,176,229 | B1 * | 1/2001 | Patenaude | F41J 9/18 | 124/8 |
| 7,263,986 | B2 * | 9/2007 | Lovell | F41J 9/30 | 124/9 |
| 7,637,255 | B1 * | 12/2009 | Freeland | F41J 9/22 | 124/8 |
| 8,899,216 | B2 * | 12/2014 | Laporte | F41J 9/24 | 124/43 |
| 8,919,331 | B2 * | 12/2014 | Rennert | F41J 9/18 | 124/1 |
| 9,057,589 | B2 * | 6/2015 | Laporte | F41B 3/04 | |
| 9,086,257 | B2 * | 7/2015 | Laporte | F41J 9/20 | |
| 10,365,072 | B1 * | 7/2019 | Liu | F41J 9/20 | |
| 10,488,162 | B2 * | 11/2019 | Laporte | F41J 9/30 | |
| 11,733,007 | B2 * | 8/2023 | Laporte | F41J 9/32 | 124/6 |
| 2006/0065258 | A1 * | 3/2006 | Lovell | F41J 9/30 | 124/9 |
| 2011/0260404 | A1 * | 10/2011 | Laporte | F41J 1/01 | 273/362 |
| 2012/0138034 | A1 * | 6/2012 | Whidborne | F41J 9/18 | 124/8 |
| 2013/0104867 | A1 * | 5/2013 | Laporte | F41J 9/20 | 124/41.1 |
| 2024/0003663 | A1 * | 1/2024 | Laporte | F41J 9/32 | |
| 2024/0230287 | A1 * | 7/2024 | Laporte | F41J 9/24 | |

FOREIGN PATENT DOCUMENTS

| | | | | |
|---|---|---|---|---|
| FR | 3095856 | A1 | 11/2020 | |
| FR | 3132568 | A1 * | 8/2023 | F41J 9/30 |

OTHER PUBLICATIONS

Written Opinion issued in corresponding International Application No. PCT/EP2022/051707, dated Apr. 5, 2022, pp. 1-4, European Patent Office, Rijswijk, Netherlands.

* cited by examiner

TARGET THROWING MACHINE

The present application is a U.S. National Phase of International Application Number PCT/EP2022/051707, filed Jan. 26, 2022, which claims priority to French Application No. 2101000, filed Feb. 2, 2021.

TECHNICAL FIELD OF THE INVENTION

The present invention relates to the field of target throwing machines. It finds as particularly advantageous applications some sport shooting practices like the "DTL", an acronym for "Down The Line" (or "American Trap"). More generally, it could apply to practices like ball-trap and proposing competitions with varied target trajectories, these targets generally consisting of clay pigeon.

PRIOR ART

Many mechanisms confer adjustable orientations on throwing machines. In particular, the patent application FR2709543A1 is known wherein a target throwing machine, shown in FIG. 1, is disclosed provided with a base 14 and a turret 6. The turret 6 being surmounted by a throwing unit 5 and fitting on a vertical and rigid shaft 7, secured to the base 14. A motor 10 ensures, through a cam 11 and a hinge tie rod 12, the rotation of the turret relative to the base according to an axis of rotation 8 in order to modify the shooting angle.

This device also allows modifying the angular opening according to which the machine is oriented, in particular thanks to the rotation of the turret relative to the base 14. To do so, the shaft 7 which supports the turret 6 should be robust enough in order to be able to transmit a torque enabling a controlled rotation. The rotational movement should be as regular as possible and this necessarily implies a good stability of the machine. In a device like that one proposed in the document FR2709543A1, the shaft should provide a high torque in order to enable the rotation of the turret 6 while withstanding at least partially the axial loads, due essentially to the weight of the rotating assembly.

In order to provide target throwing machines more and more effective, there is a need to optimise the stability of the machine. Indeed, during the throwing phase, the distribution of the masses tends to unbalance the machine which could then slightly vacillate.

The document CH508193A5 is known from the prior art in which a technical solution is disclosed comprising a ball bearing system enabling the stabilised rotation of a turret. Nevertheless, besides the fact that this solution could turn out to be expensive, it would not allow sufficiently taking up the axial loads and what is more, an excessively optimised rotation would undoubtedly result in a vacillation of the device at the end of throw.

The document US20060065258A1 is also known from the prior art describing a device wherein a spacer enables the rotation of a turret by slipping. Nevertheless, this solution is insufficient because it does not enable a good cooperation by sliding.

Hence, an object of the present invention is to provide a system allowing improving a machine having a turret movable in rotation relative to a base.

The other objects, features and advantages of the present invention will appear upon examining the following description and the appended drawings. It is understood that other advantages can be incorporated therein.

SUMMARY OF THE INVENTION

To achieve this objective, according to one embodiment, a target throwing machine is provided, comprising a base and a turret surmounted by a throwing unit, the turret being movable in rotation relative to the base according to a main axis, the base comprising an upper surface and the turret comprising a lower surface opposite the upper surface, in which machine an intermediate system is interposed between the upper surface and the lower surface, the intermediate system being in contact with the upper surface and with the lower surface and forming a sliding interface between the intermediate system and the upper surface and/or the lower surface.

Without this machine, the turret would be unstable unless an oversized connection mechanism is used consisting of a pivot axis inserted into a hub fitted with two bearings. This solution requires a robust carrier shaft capable of transmitting a high torque necessary to a stable and accurate rotation of the turret. However, the user of this device type decreases the accuracy of the machine and increases its energy consumption as well as its manufacturing cost. This solution type decreases the stability of the machine as the machine is raised by 60 to 200 mm.

Thus, it is herein possible to reduce the size of the device by getting rid of a robust shaft and a stabilised rotation with an optimised inertia is allowed.

Thus, the height of the thrower is reduced. The pivot axis is replaced by a substantially simplified and inexpensive part, compatible with high loads and requiring very low energy consumption.

Hence, this preferably enables the simplified and improved rotation of a turret relative to a base in a target throwing machine. In a preferred embodiment, the friction coefficient induced by the intermediate system is not selected very low, which might seems to be counter-intuitive, but which confers an adherence effect of the turret relative to the base when it is fixed; some inertia should then be overcome to set it in motion, which promotes the suppression of the parasitic movements of the turret when it is fixed, for example when a target loading revolving cylinder is set in movement or when the throwing arm is actuated.

BRIEF DESCRIPTION OF THE FIGURES

The aims, purposes, characteristics and advantages of the invention will be better understood upon reading the detailed description of one embodiment thereof, which is illustrated by means of the following accompanying drawings, in which.

Figure 1:
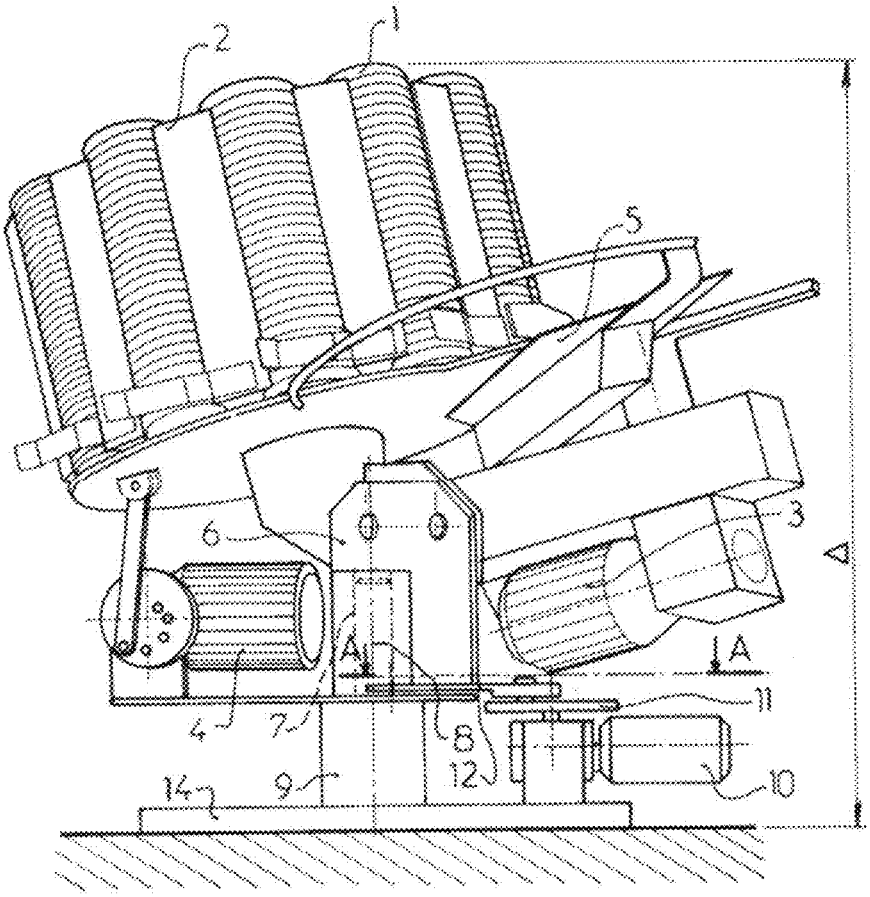
FIG. 1 shows an example of a target throwing machine known from the prior art.

The drawings are provided by way of example and are not intended to limit the scope of the invention. They constitute diagrammatic views intended to ease the understanding of the invention and are not necessarily to the scale of practical applications.

DETAILED DESCRIPTION

Before starting a detailed review of embodiments of the invention, optional features that may be used in combination or alternatively are set out hereinafter:

According to one example, the intermediate system 100 comprises an upper contact face 101 configured to form a sliding interface with the lower surface 302, and wherein the upper contact face 101 is made of a first material, the upper surface 201 is made of a second material and the lower surface 302 is made of a third material such that the dynamic friction coefficient μ1/3 between the first material and the third material is higher than or equal to 0.04 and/or is lower than or equal to 0.3, preferably higher than or equal to 0.15 and/or lower than or equal to 0.3, preferably higher than or equal to 0.18 and lower than or equal to 0.22 and is preferably equal to 0.2.

This enables a controlled slip of the turret 300 with the intermediate system 100.

Indeed, in the context of a target throw from a fixed machine, the turret 300 should be as stable as possible in order to be able to perform the most accurate throw. Therefore, slipping with the intermediate system should be possible yet with some limit to avoid a forced braking by the actuator.

According to one example, the intermediate system 100 comprises a lower contact face 102 configured to form a sliding interface with the upper face 201, and wherein the lower contact face 102 is made of a fourth material, the upper surface 201 is made of a second material and the lower surface 302 is made of a third material such that the dynamic friction coefficient μ4/2 between the fourth material and the second material, is higher than or equal to 0.04 and/or lower than or equal to 0.3, preferably is higher than or equal to 0.15 and/or lower than or equal to 0.3, preferably higher than or equal to 0.18 and lower than or equal to 0.22 and is preferably equal to 0.2.

This enables a controlled slip of the intermediate system 100 with the base 200.

According to one example, the intermediate system 100 comprises at least one self-lubricating part.

According to one example, the intermediate system 100 comprises at least one sliding part made of a material comprising brass and graphite. More generally, all or part of the sliding parts may be based on a metal or an alloy of metals (in particular steel, copper, brass, or bronze), preferably to amount to at least 70% by weight of the overall material of the part. Preferably, this material also incorporates graphite, in a lower weight proportion than the metal or the alloy of metals; it may consist of inserts made of graphite within the metallic matrix. For example, it is possible to use self-lubricated pads of the brand Misumi®.

According to one example, the intermediate system 100 comprises several sliding parts.

Preferably, a plurality of sliding parts allows having a sufficient sliding surface while limiting the production cost of the parts and in order to improve the stability of the device while distributing the loads. When confronted with the problem of increasing the stability of a device while limiting the production costs of the parts, nothing in the document US20060065258A1 allows reaching the technical solution wherein the intermediate system 100 comprises a plurality of sliding parts.

According to one example, the intermediate system 100 comprises at least one sliding part made of a polymer material, preferably of polytetrafluoroethylene.

According to one example, the intermediate system 100 comprises at least one set of sliding parts being such that its parts are distributed radially and evenly around the main axis.

According to one example, in section, according to a plane perpendicular to the main axis 700, the intermediate system 100 admits a section S so that the surface area of the section S is located between 15% and 30% and preferably between 20% and 25% of a contact surface corresponding to the projected surface which corresponds to the contact surface of the turret 300 contiguous to the base 200 in the absence of an intermediate system 100.

According to one example, the base 200 comprises a central element 210, centred with the main axis 700 and configured to position the turret 300 with respect to the base 200.

According to one example, the central element 210 projects on the intermediate system 100, the intermediate system 100 comprising a central sliding part 110, preferably fixed with respect to the base 200 and having a bearing surface 111 configured to take up the axial loads of the turret 300.

According to one example, the distance between the upper surface 201 and the lower surface 302 is larger than or equal to 4 mm and is smaller than 10 mm.

According to one example, a motor-driven actuator 600 is configured to set the turret 300 in rotation relative to the base 200.

According to one example, the actuator 600 is an electric cylinder associated with a transmission system like for example a connecting rod/crank system.

It should be pointed out that in the context of the present invention, the term "thrower" is sometimes used instead of "machine" as a claimed object, these terms should be considered as equivalent.

In the context of the invention, "radial orientation" or "radially" refer to the positioning of an element movable in rotation with respect to an axis.

In the context of the present invention, by dynamic friction coefficient denoted p (or slip coefficient), it should be understood the proportionality constant between the friction force T (or the slip resistance force) and the normal reaction N of Coulomb's law.

$$T=\mu \cdot N$$

The terms "substantially", "about", "in the range of" mean "within a 10% margin, preferably within a 5% margin" or, when it consists of an angular orientation, "within a 10° margin". Thus, a direction substantially normal to a plane means a direction having an angle of 90±10° with respect to the plane.

In the following description, the term "over" does not necessarily mean "directly over". Thus, when it is indicated that a part or a member A bears "on" a part or a member B, this does not mean that the parts or members A and B are necessarily in direct contact with the other. These parts or members A and B can either be in direct contact or bear on one another through one or more other part(s). The same applies for other expressions such as the expression "A acts on B" which could mean "A acts directly on B" or "A acts on B through one or more other part(s)".

In the present disclosure, the term movable corresponds to a rotational movement or to a translational movement or to a combination of movements, for example the combination of a rotation and a translation.

In the present disclosure, when it is indicated that two parts are distinct, this means that these parts are separate. They are:

positioned at distances from each other, and/or movable relative to each other and/or secured to each other by being fastened by added elements, this fastening being removable or not.

Hence, a one-piece unitary part cannot be formed by two distinct parts.

In the present patent application, the term "secured" used to describe the connection between two parts means that the two parts are bound/fixed to each other, according to all degrees of freedom, unless stated otherwise. For example, if it is indicated that two parts are secured in translation according to a direction X, this means that the parts could be movable relative to each other except according to the direction X. In other words, if a part is moved according to the direction X, the other part performs the same movement.

General Structure

Figure 2:
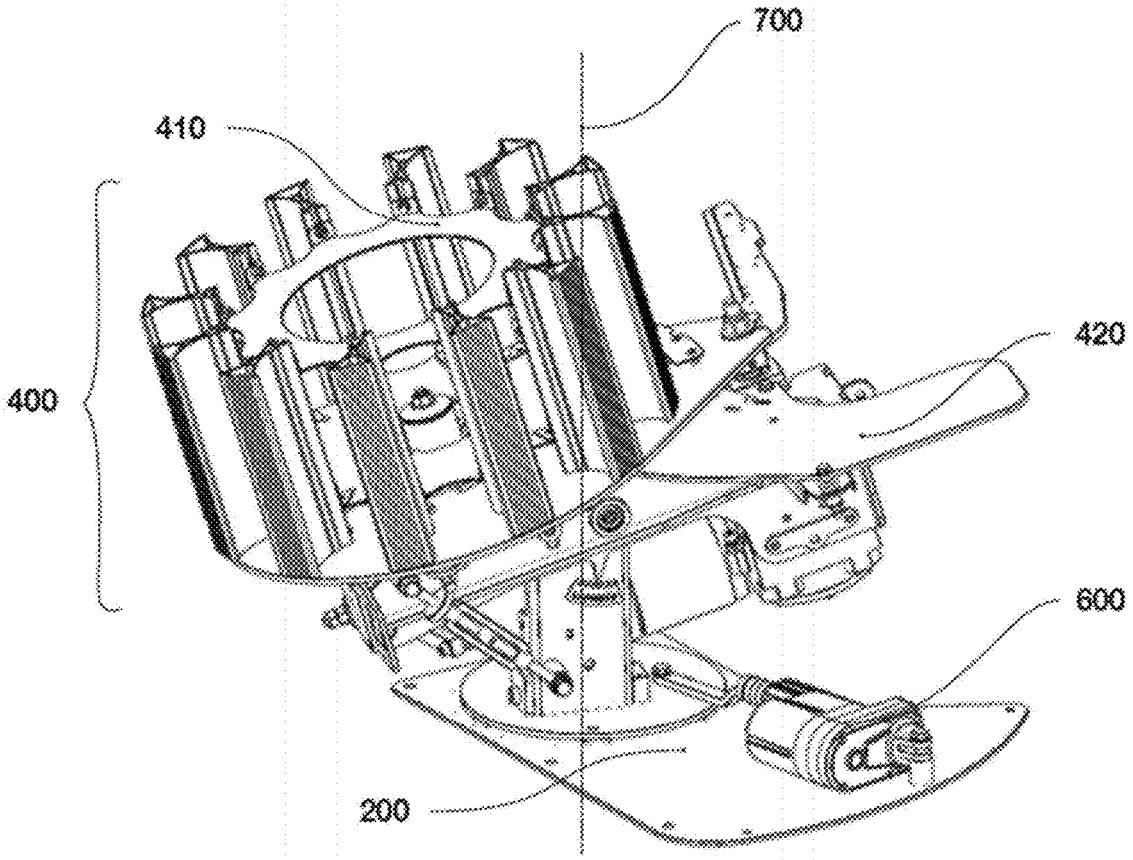
FIG. 2 shows an example of a target throwing machine which could comprise an intermediate system according to the present invention.

As illustrated in FIG. 2, and according to one example, the throwing machine comprises a base 200, this base 200 is preferably fixed relative to the ground. A turret 300 is arranged over this base 200 surmounted by a throwing unit 400. Preferably, the throwing unit 400 comprises a revolving cylinder 410 configured so as to be able to store the targets of the machine. The throwing unit 400 may also comprise a tray 420 on which the targets will be deposited during a throwing phase. The machine may also comprise an actuator 600, configured so as to enable the motor-driven rotation of the turret relative to the base 200.

Figure 3:
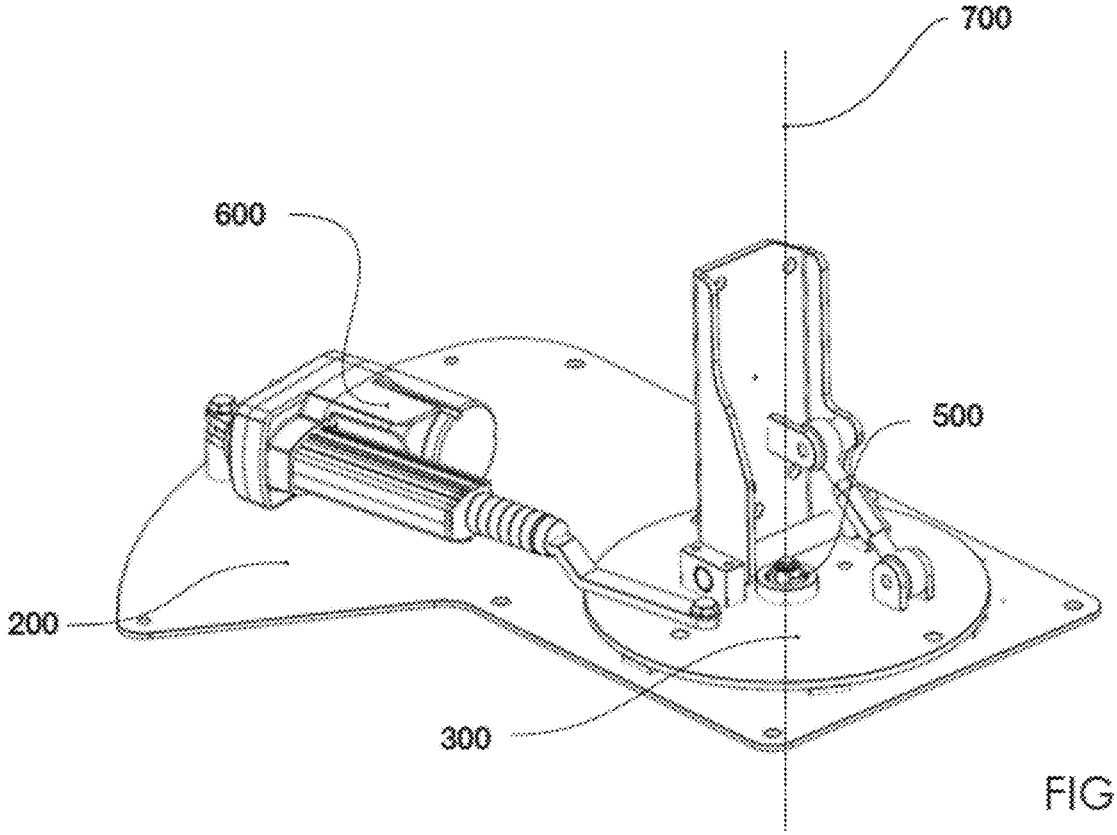
FIG. 3 shows an example of a pivot connection between the turret and the base of a machine according to the present invention.

As illustrated in FIG. 3, the turret 300 is configured so as to be movable in rotation relative to the base 200 according to the main axis 700.

According to one embodiment, the turret 300 is in pivot connection with the base 200. Preferably, axial stoppage according to the main axis 700 is performed with a fastening element 500 configured to enable clamping of the turret 300 with the base 200. Preferably, the base 200 is a metallic plate or sheet metal advantageously cut and configured so as to be able to be positioned and then held in position in contact with the ground. Preferably, the base 200 is thus fixed relative to the ground. This secure connection may be performed using bolting elements, preferably anchor studs.

Preferred Embodiment—Kinematic Approach

Figure 4:
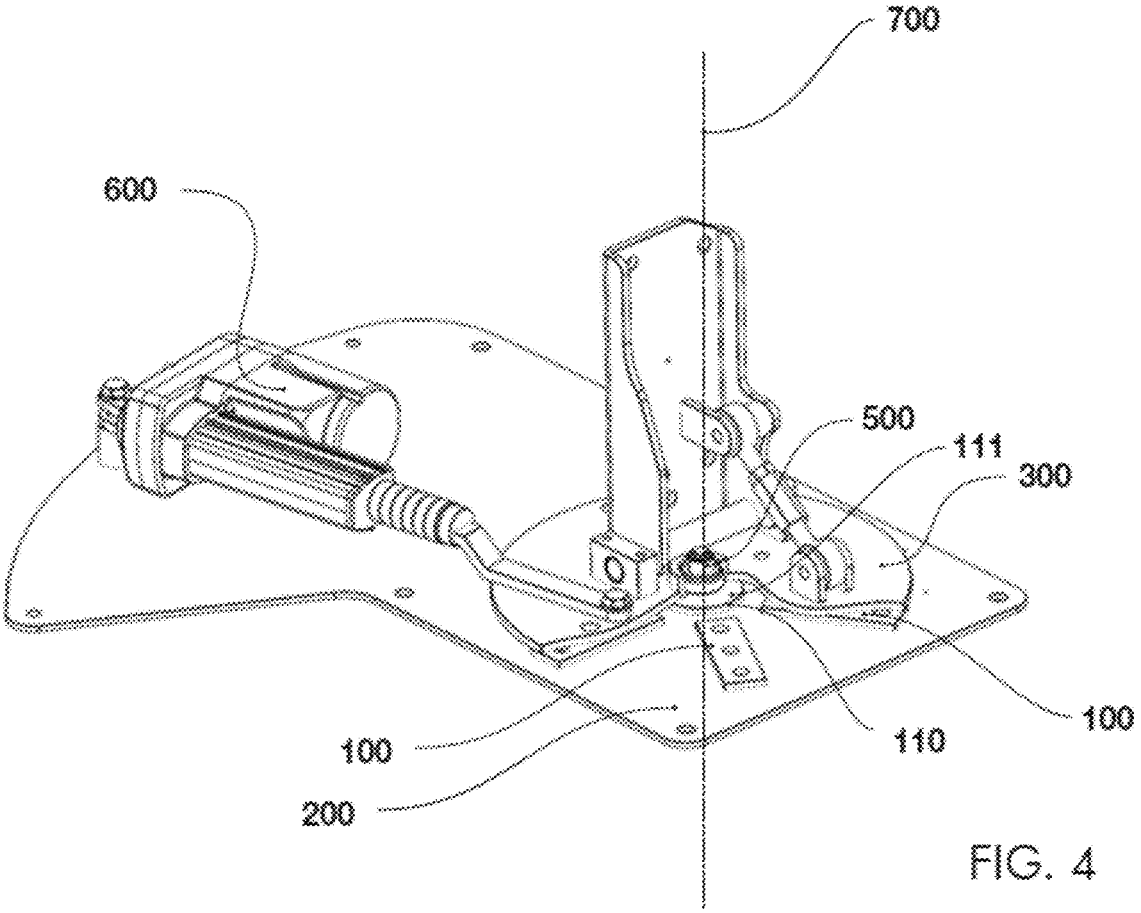
FIG. 4 shows a partial sectional view of the example of a pivot connection between the turret and the base illustrated in FIG. 3.
Figure 5:
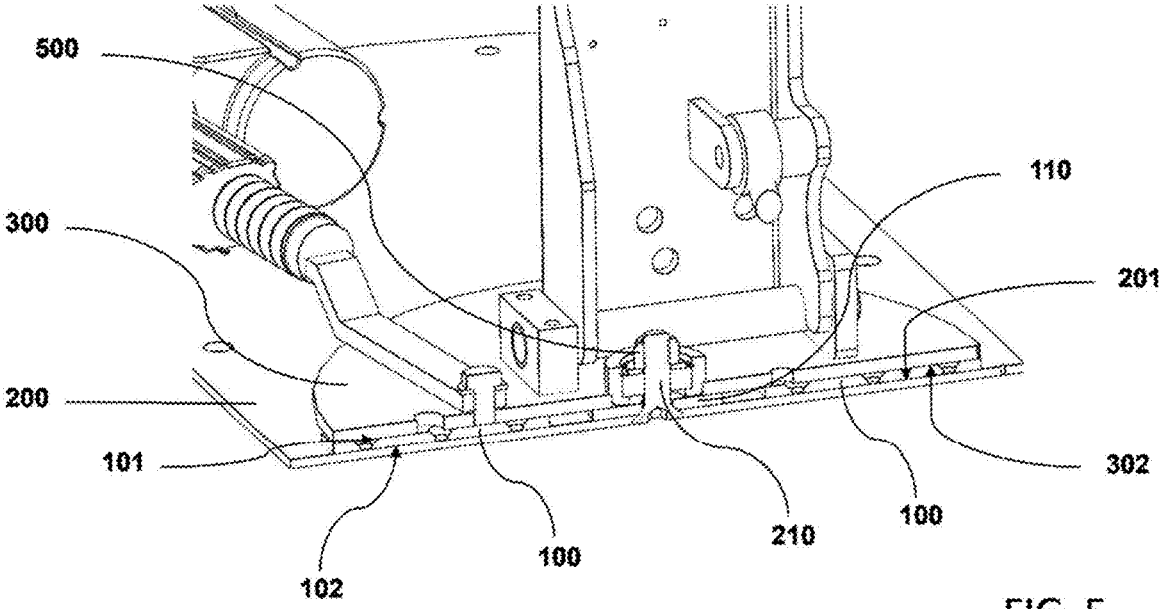
FIG. 5 shows an enlarged sectional view of the example of a pivot connection between the turret and the base illustrated in FIG. 3.

As illustrated in FIG. 4 and in FIG. 5, and according to a preferred embodiment of the invention, the throwing machine comprises an intermediate system 100 comprising an upper contact face 101 and a lower contact face 102 at least one of which is a sliding surface. The intermediate system 100 is interposed between the base 200 and the turret 300 so as to enable sliding of at least one element amongst the base 200 and the turret 300 with the intermediate system 100. In turn, the base 200 comprises an upper surface 201 and the turret 300 comprises a lower surface 302. These two surfaces face each other.

The intermediate system 100 is in contact simultaneously with the upper surface 201 of the base 200 and the lower surface 302 of the turret 300, respectively at its lower contact face 102 and its upper contact face 101. Advantageously, the intermediate system 100 is also fastened on one amongst the upper surface 201 and the lower surface 302.

Furthermore, the turret 300 is advantageously movable in rotation relative to the base 200 according to a main axis 700. The intermediate system 100 is interposed between the upper surface 201 and the lower surface 302 and is in direct and simultaneous contact with the upper surface 201 and the lower surface 302 and thus forms a sliding interface between the intermediate system 100 and the upper surface 201 or between the intermediate system 100 and the lower surface 302.

Preferred Embodiment

According to a preferred embodiment, the turret 300 and the intermediate system 100 are in planar contact. Preferably, the intermediate system 100 is secured to the base 200 and the turret 300 slips freely over the intermediate system 100. Thus, according to this example, the machine is configured so that the lower surface 301 of the turret 300 is free to slip over the upper contact face 101 of the intermediate system 100.

According to an illustrated embodiment, the intermediate system 100 is secured to the base 200, this secure connection may be achieved using fastening elements like for example screwing elements.

As illustrated in FIG. 4 and according to one example, the device comprises a base 200 on which the intermediate system 100 is positioned which comprises sliding parts and a central sliding part 110. The turret 300 being positioned over and in contact with the sliding parts and the central sliding part 110. Preferably, the turret 300 comprises a hub in which a bearing and a locking system are mounted so as to enable a pivot connection between the base 200 and the turret 300 by rotation of the turret 300 around the central element 210.

As illustrated in FIG. 5, and according to this same example, the central sliding part 110 is configured to cooperate by form-fitting with a central element 210 secured to the base 200. This allows ensuring positioning of the intermediate system 100 with respect to the base 200.

Advantageously, the central sliding part 110 comprises a bearing surface 111 configured to enable contact and at least partially taking up the axial loads according to the main axis 700.

In turn, the central element 210 is configured to allow at least partially taking up the radial loads of the turret 300 with respect to the base 200.

According to one example, the intermediate system 100 is securely mounted on the at least one amongst the two elements amongst the base 200 and the turret 300.

Figure 6:
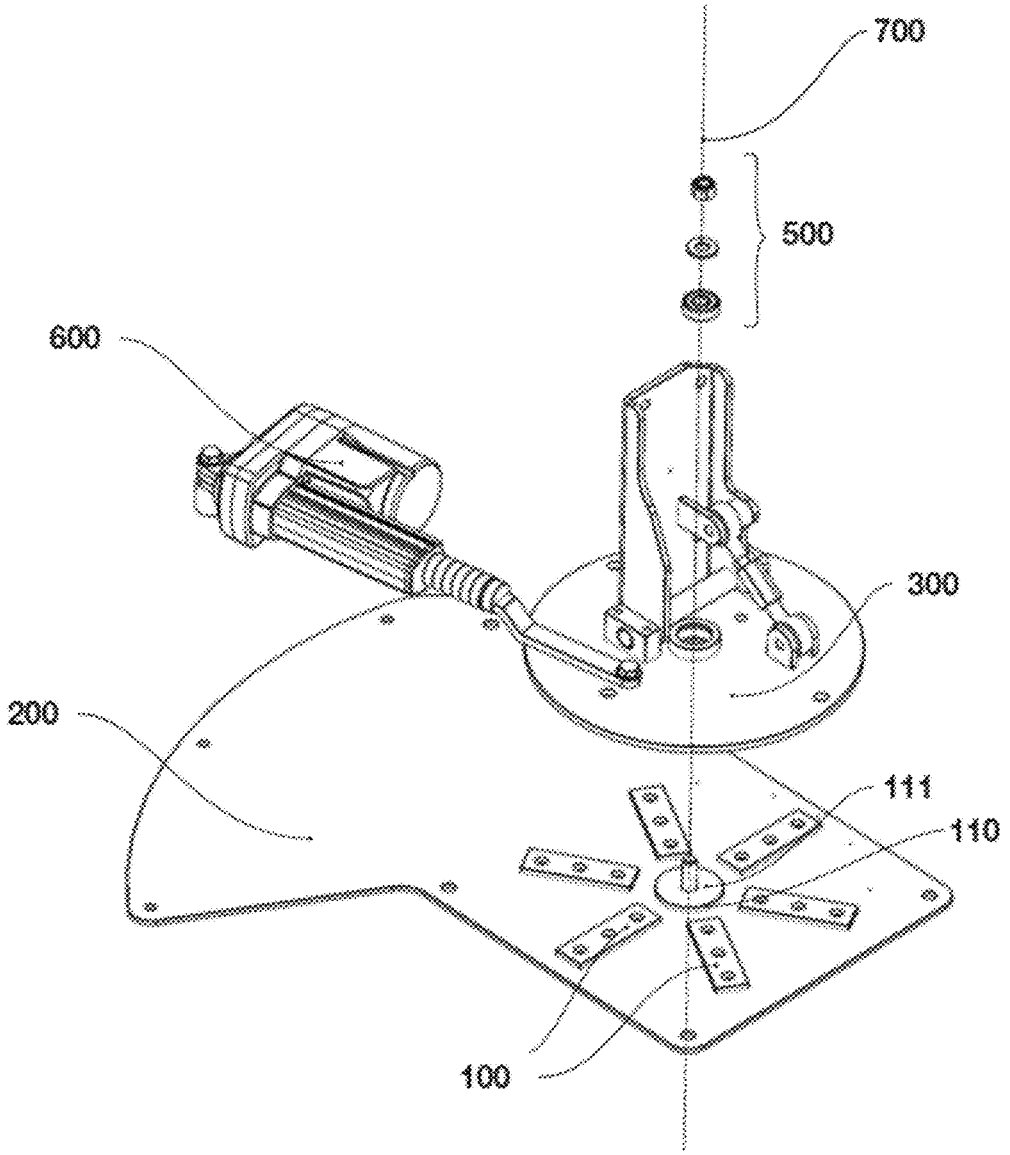
FIG. 6 shows an exploded view of the example of a pivot connection between the turret and the base illustrated in FIG. 3.

As illustrated in FIG. 6 and according to this example, the device is configured so as to be able to be mounted according to a series of successive steps:

fixing the base 200 comprising a central element 210 with respect to the ground by at least one fastening device which may consist of bolting elements, possibly screws with countersunk heads. securely fastening the intermediate system 100 to the base 200, the intermediate system 100 comprising six sliding parts and a central sliding part 110, comprising a bearing surface 111, fastening being possibly performed by means of fastening elements, it could consist of bolting elements and preferably of threaded elements.

positioning the turret 300 on the intermediate system 100 by planar contact on the plane of the upper contact face 101 with the lower surface 302, positioning the turret 300 is performed using the central element 210 and by cooperation of the lower surface 302 with the bearing surface 111, locking, according to the direction taken by the main axis 700, the pivot connection between the turret 300 and the base 200 using fastening elements 500, securing an actuator 600, to the base 200 and to an anchor point of the turret 300.

Dynamic Friction Coefficient

According to one example, the upper contact face 101 is made of a first material, the lower contact face 102 of the intermediate system 100 is made of a fourth material, whereas the upper surface 201 of the base 200 is made of a second material and finally the lower surface 302 of the turret 300 is made of a third material.

According to a preferred embodiment, the materials are preferably selected so that the dynamic friction coefficient ($\mu_{1/3}$) between the first material and the third material is higher than or equal to 0.04 and/or is lower than or equal to 0.3, preferably higher than or equal to 0.15 and/or lower than or equal to 0.3, preferably higher than or equal to 0.18 and lower than or equal to 0.22 and is preferably equal to 0.2.

According to another embodiment, the materials are selected so that the dynamic friction coefficient ($\mu 4/2$) between the fourth material and the second material is higher than or equal to 0.04 and/or is lower than or equal to 0.3, preferably higher than or equal to 0.15 and/or lower than or equal to 0.3, preferably higher than or equal to 0.18 and lower than or equal to 0.22 and is preferably equal to 0.2.

The first and third materials may be identical in particular; it may consist of surfaces made of steel.

Configuration of the Intermediate System

According to one example, the intermediate system 100 comprises a sliding part configured so as to be positioned between the base 200 and the turret 300.

Preferably, the sliding part may be a self-lubricating or an oil-free pad, preferably made of brass and preferably comprising graphite particles. For example, the pad has a rectangular shape which may have a thickness of 4 mm. Preferably, the thickness of the intermediate system is larger than or equal to 4 mm and smaller than 10 mm.

According to one embodiment, the intermediate system 100 comprises several sliding parts distributed radially and evenly around the main axis 700.

According to a particular embodiment wherein the intermediate system 100 is secured to the base 200, in section according to a plane perpendicular to the main axis 700, the intermediate system 100 advantageously admits a section S, so that the surface area of the section S is located between 15% and 30% and preferably between 20% and 25% of a contact surface area corresponding to the projected surface which corresponds to the contact surface of the turret 300 contiguous to the base 200 in the absence of an intermediate system 100.

Mechanical Approach

According to one example, taking up the load according to the main axis 700, generated by the weight of the throwing unit 400 is performed at least partially and successively by the turret 300 then by the intermediate system 100 and finally by the base 200. In order to be able to optimise the throwing machine, the present invention allows for a larger support of the turret 300 in order to allow for a better balance thanks to the largest contact surface as possible according to a plane perpendicular to the main direction 700.

Advantageously, the space between the turret 300 and the base 200 is smaller than 10 mm, preferably smaller than 8 mm, preferably smaller than 6 mm, preferably larger than or equal to 4 mm.

Advantageously, the base 200 is not in direct contact with the turret 300.

Motor Drive

According to one example, the rotation of the turret 300 relative to the base 200 may be motor-driven by means of an actuator 600. Advantageously, this actuator 600 comprises an electric cylinder connected to a transmission system, which may possibly consist of a connecting rod/eccentric system or a connecting rod/crank system.

Advantageously, the actuator 600 comprises an electric cylinder, attached at its end to the turret 300 at an anchor point intended to this end. A 12V electric cylinder could be used.

OTHER EMBODIMENTS

Preferably, the intermediate system 100 comprises at least one plane of symmetry comprising the main axis 700.

Preferably, the intermediate system 100 comprises intermediate parts whose projection in a plane perpendicular to the main axis 700 covers a larger surface, preferably at least twice as large, than the projection of the turret 300 in this plane.

Thus, this system type allows adjusting the distribution of the loads, according to the main axis 700, related to the weight of the turret 300 on the base 200.

According to a particular embodiment, there is a non-zero friction of the turret 300 support against the intermediate parts. Advantageously, the friction occurs in the plane where contact between the turret 300 and the intermediate system 100 takes place. Alternatively, the friction occurs in the plane where contact between the base 200 and the intermediate system 100 takes place.

Advantageously, some intermediate parts consist of pads, preferably rectangular, distributed, preferably in a star-like fashion, around the main axis 700, preferably homogeneously. For example, there are at least three pads. A long dimension of the pads may be directed radially, i.e. perpendicularly to the main axis 700.

Advantageously, the intermediate parts are distributed under the turret so as to increase the contact surface between the turret 300 and the intermediate system 100, or, complementarily or alternatively, so as to increase the contact surface between the base 200 and the intermediate system 100

Preferably, the turret 300 comprises a post and at its lower end, a turret support 300.

Advantageously, the turret support 300 is a plate, preferably with a circular contour, and which may extend according to a constant thickness in a plane perpendicular to the main axis 700.

Preferably, the post of the turret 300 extends from a first face and a second free face, in parallel opposite to the first face, forms a sliding surface.

Preferably, the sliding surface extends beyond the projection of the post on the plate.

Thus, the intermediate system is configured so as to enable a trade-off between the largest contact surface as possible with the turret 300 to allow for a better dynamic stability of the device while guaranteeing an optimised contact between the sliding surface and the intermediate system 100.

According to a particular embodiment, the projection of the intermediate parts in a plane perpendicular to the main axis 700 is inscribed within a disk with a diameter larger than 30 cm.

According to a particular embodiment, the surface that cooperates with the sliding face of the intermediate system 100 (i.e. at least one amongst the upper face 201 and the lower face 302) itself has a low friction; it may consist of an improved surface condition of the base material respectively of the base and of the turret, or of a superficial layer, respectively of the base and of the turret, made of a material reducing friction; for example, it may consist of an anti-adhesive coating whose exposed face forms the sliding face over that one amongst the base and the turret relative tow which the intermediate system 100 slides.

According to one example, the target throwing machine comprises an angular setting device.

Advantageously, the setting device comprises markings with graduations allowing directing the machine according to a predefined angular sector.

According to a particular embodiment, the machine comprises at least one sensor, preferably to delimit the angular range and inverse the direction of rotation of the motor. Advantageously, the sensors are dedicated to positioning of the cylinders and may be of the potentiometer, optical or Hall effect type. It could consist of a sensor whose number of pulses per mm of stroke is 12,599 and/or the admitted load is 6,000 Newton.

According to a particular embodiment, the intermediate system 100 is made as a one-piece part.

This allows for a better planarity and a simplified mounting of the device.

According to a particular embodiment, the intermediate system 100 and the base 200 form one single set, these two portions being fastened to each other.

According to a particular embodiment, the intermediate system 100 is a slipping film. It may consist of a polymer material, and in particular of polytetrafluoroethylene; it may consist of a solid film, but also possibly of a fluid film.

According to a particular embodiment, the actuator 600 enables the rotational drive of the turret 300 by associating a motor or an electric or hydraulic cylinder with a pinion/chain system or with a gear train system or with a pulley/belt system.

According to a particular embodiment, the machine comprises a system for locking an angular position in order to avoid any undesirable angular movement of the machine during a shooting phase.

According to a particular embodiment, the dynamic friction coefficient between the lower face 302 over the upper surface 101 is higher than or equal to 0.04 and/or is lower than or equal to 0.3, preferably higher than or equal to 0.15 and/or is lower than or equal to 0.3, preferably higher than or equal to 0.18 and lower than or equal to 0.22 and is preferably equal to 0.2. The coefficient should be comprised between an upper bound and an upper bound in order to enable on the one hand enough slipping to the rotation of the turret 300 relative to the intermediate system 100 and on the other hand a lower bound to enable a minimum friction necessary to braking of the turret.

Indeed, according to this same embodiment, the turret 300 is preferably mounted idling and consequently, it is not only driven in rotation by the actuator 600 but also braked and then stopped by the latter. Thus, an excessively low friction coefficient would impart undesirable mechanical forces on the actuator 600, such as in particular during a deceleration phase of the turret 300. An excessively low dynamic frication coefficient would require an additional safety like for example the use of an additional locking system.

According to one embodiment, the intermediate system 100 comprises a circular and/or annular sliding part centred radially around the main axis 700, as is the case of the part 110; possibly it may comprise at least two concentric annular elements.

According to a particular embodiment, the intermediate system 100 comprises a sliding part made of Teflon® or of plastic in order to reduce the manufacturing costs.

According to a particular embodiment, the intermediate system 100 may preferably consist of a coating over the base 200.

According to a particular embodiment, the machine comprises a set of three superimposed layers, where the base 200, the intermediate system 100 and the turret 300 alternate successively. Thus, the machine has the advantage of evenly distributing the load over a wide surface and thus enables a simplification of the loaded structures.

According to a particular embodiment, the base 200 is fixed and is made of a plate made of steel, which may for example have a thickness of 4 mm and configured so as to enable arranging thereon a plurality of sliding parts, preferably, these will consist of self-lubricating pads. All pads are configured so as to be able to be distributed according to a circular configuration centred around the main axis 700.

According to a particular embodiment, the turret 300 has for example a base with a circular shape and with a thickness which may be 4 mm. Preferably, the base pierced at its centre in order to generate a complementary surface and is surmounted by a ring containing a bearing. Thus, this enables a short centring associated with a surface contact generating a friction optimising the stability of the machine. Preferably, the upper 201 and lower 302 surfaces are circular and disposed according to the same axis.

According to a particular embodiment, the machine may be set according to a method comprising the following steps:

- varying the angle defining the scanning range,
- varying the angular positioning of the scanning range,
- fixing the machine on positions defined according to a sorted or random order
- saving in the memory positions validated during the shooting sequence,
- defining its own shooting sequence.

The invention is not limited to the aforementioned embodiments, and includes all the embodiments covered by the claims.

REFERENCE NUMERALS

100. intermediate system
101. upper contact face
102. lower contact face
110. central sliding part
111. bearing surface
200. base
201. upper surface
210. central element
300. turret
302. lower surface
400. throwing unit
500. fastening element
600. actuator
700. main axis

The invention claimed is:

1. A target throwing machine, comprising:

a base, and a turret surmounted by a throwing unit, wherein, the turret being movable in rotation relative to the base according to a main axis, the base comprising an upper surface and the turret comprising a lower surface opposite the upper surface, wherein, the target throwing machine comprising:

an intermediate system interposed between the upper surface and the lower surface, the intermediate system being in contact with the upper surface and the lower surface and forming a sliding surface between the intermediate system and the upper surface and/or the lower surface, the sliding surface comprising several separate sliding parts.

2. The target throwing machine according to claim 1, wherein the intermediate system comprises an upper contact face configured to form a sliding interface with the lower surface, and wherein the upper contact face is made of a first material, the upper surface is made of a second material and the lower surface is made of a third material such that a dynamic friction coefficient between the first material and the third material is higher than or equal to 0.04 and lower than 0.3.

3. The target throwing machine according to claim 1, wherein the intermediate system comprises a lower contact face configured to form a sliding interface with the upper surface, and wherein the lower contact face is made of a fourth material, the upper surface is made of a second material and the lower surface is made of a third material such that a dynamic friction coefficient between the fourth material and the second material is higher than or equal to 0.04 and lower than 0.3.

4. The target throwing machine according to claim 1, wherein the intermediate system comprises at least one self-lubricating sliding part.

5. The target throwing machine according to claim 1, wherein the intermediate system comprises at least one sliding part made of a material comprising brass and graphite.

6. The target throwing machine according to claim 1, wherein the intermediate system comprises at least one set of sliding parts that are distributed radially and evenly around the main axis.

7. The target throwing machine according to claim 1, wherein, in section according to a plane perpendicular to the main axis, the intermediate system admits a section so that a surface area of the section is located between 15% and 30% of a contact surface area corresponding to a projected surface which corresponds to a contact surface of the turret contiguous to the base in absence of an intermediate system.

8. The target throwing machine according to claim 1, wherein the base comprises a central element, centered on the main axis and configured to position the turret with respect to the base.

9. The target throwing machine according to claim 8, wherein the central element projects on the intermediate system, the intermediate system comprising a central sliding part having a bearing surface configured to take up at least partially an axial loads of the turret.

10. The target throwing machine according to claim 1, wherein a distance between the upper surface and the lower surface is larger than or equal to 4 mm and is smaller than 10 mm.

11. The target throwing machine according to claim 1, comprising a motor-driven actuator configured to set the turret in rotation relative to the base.

12. The target throwing machine according to claim 11, wherein the actuator is an electric cylinder associated with a transmission system.

* * * * *